United States Patent [19]

Lacy

[11] Patent Number: 4,986,226

[45] Date of Patent: Jan. 22, 1991

[54] INTERNAL COMBUSTION ENGINE

[76] Inventor: James W. Lacy, 255 McCart St., Fernley, Nev. 89408

[21] Appl. No.: 467,981

[22] Filed: Jan. 22, 1990

[51] Int. Cl.[5] ..... F02B 75/26

[52] U.S. Cl. ..... 123/58 BC

[58] Field of Search ..... 123/58 B, 58 BB, 58 BC

[56] References Cited

U.S. PATENT DOCUMENTS 4,523,549 6/1985 Lacy ..... 123/58 BC 4,622,927 11/1986 Wenker ..... 123/58 BC

*Primary Examiner*—Willis R. Wolfe

*Assistant Examiner*—T. Moulis

*Attorney, Agent, or Firm*—Owen, Wickersham & Erickson

[57] ABSTRACT

An internal combustion engine comprising an engine block including a plurality of parallel, spaced apart cylinder modules, each module having a cylinder bore and a pair of pistons in each bore which are simultaneously movable in opposite directions and a rotatable shaft parallel to the cylinder modules. A wobbler member connected to and rotatable with the shaft means, has a pair of end portions connected by a central portion, each end portion having a centerline forming an angle with the rotatable shaft and wobbler end portion. A pair of bearing members are provided within each spider assembly and located at opposite ends of each wobbler end portion, each having a general frustro-conical annular shape with relieved areas in its outer surface to provide reduced bearing contact areas and bearing friction. A connecting rod for each piston is fixed at its outer end to the spider assembly and is connected at its inner end to a piston so as to provide both rotational as well as linear side movement of the connecting rod inner end within the piston. A lubrication system supplies liquid lubricant under pressure to both the bearings and the inner ends of said pistons.

15 Claims, 6 Drawing Sheets

INTERNAL COMBUSTION ENGINE

This invention relates to internal combustion engines and more particularly to an improvement for engines having opposed pistons connected to a wobbler mechanism that converts the reciprocatory piston movement into rotary movement of a shaft.

BACKGROUND OF THE INVENTION

In engines of the aforesaid type opposed pairs of pistons are connected at opposite ends of an engine block to a pair of spider members, each of which surrounds a wobbler that is connected to a rotary shaft. Such an arrangement is shown in my previous U.S. Pat. No. 4,523,549 and also generally in other patents, such as U.S. Pat. Nos. 3,007,462, 3,528,394 and 4,489,682. Although various design versions of the basic arrangement as described have been proposed, as set forth in the aforesaid and other prior patent disclosures, a successful, reliable and durable engine was not developed prior to the present invention. Among the serious problems which the prior art patents failed to solve were: (1) the provision of a satisfactory, durable connection between the spider and each piston which eliminated severe wear conditions on the connecting rod due to the normal wobbling action of the spider; (2) severe bearing stresses between each pair of spider and wobbler components which caused excessive friction; (3) the provision of an adequate lubrication system that assured proper engine operation under various conditions; (4) the provision of an efficient and effective means for changing the engine timing and thus its speed under varying loads. The present invention provides an improved wobbler type engine which solves the aforesaid problems.

SUMMARY OF THE INVENTION

In accordance with the principles of the invention an engine block is provided having one or more cylinder bores and a shaft disposed in the block. Within each bore is a pair of opposed pistons and each piston has a connecting rod attached to a spider member which extends around the shaft. Thus, there are two spider members at opposite ends of the engine. Within the bore of a barrel section for each spider member is a wobbler which rotates within the barrel section and is keyed to an engine shaft. One important feature of the invention provides for a bearing means at opposite ends of each wobbler that withstands the severe loads of each engine power stroke while providing smooth operation with a minimum of bearing friction. Each bearing has a generally annular configuration with spaced apart frustroconical portions separated by relieved areas. The frustro-conical portions are positioned on the wobbler at locations of bearing stress with the relieved areas being located at areas of no stress and thereby greatly reducing overall bearing friction. Radially extending arms of each spider member are fixed to an outer end of a connecting rod. In accordance with another feature of the invention the inner end of each connecting rod is attached to a piston by a connector assembly comprised of a plurality of interconnected elements that allows the connecting rod to move as required in several directions during each power and return stroke so as to provide smooth operation with minimum wear and friction. Additional features of the invention include the provision of a pressurized lubrication system for all moving parts of the engine and a timing adjustment and control means for changing engine speed.

Other objects, advantages and features of the present invention will become apparent from the following detailed description of embodiments thereof, presented in conjunction with the accompanying drawing.

DETAILED DESCRIPTION OF EMBODIMENT

General Description

Figure 1:
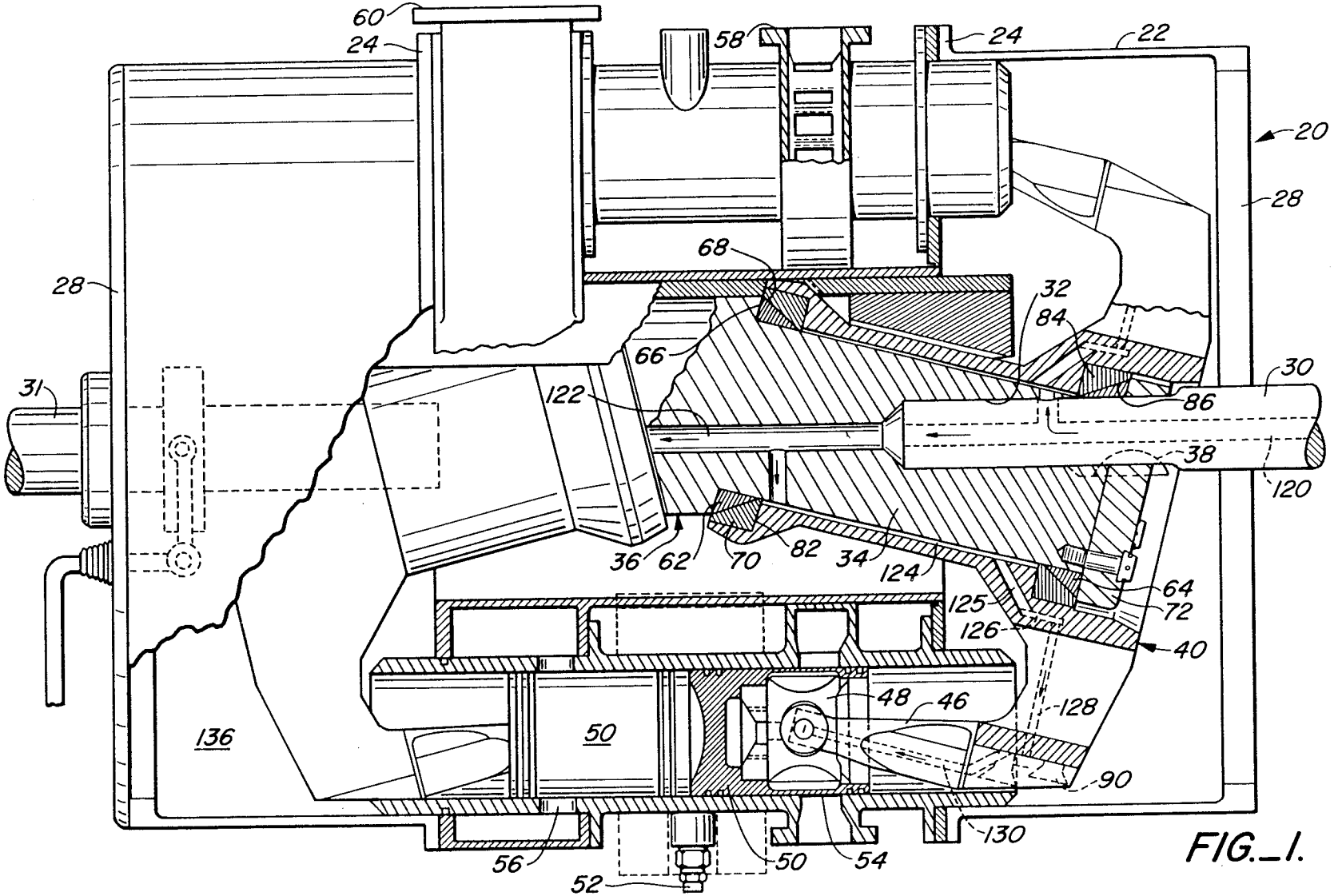
FIG. 1 is a view in elevation and partially in section of an engine embodying principles of the present invention.

With reference to the drawing, FIG. 1 shows an engine 20 embodying principles of the present invention with portions broken away to illustrate internal structural features. In general, the engine comprises a central, generally cylindrical block or housing 22 having an annular flange 24 or torque plates near each of its opposite ends which support a plurality of circumferentially spaced apart cylinder modules 26 that are positioned radially from the axial centerline of the block. In the embodiment illustrated, two cylinder modules are shown, but other embodiments with additional cylinder modules could be provided utilizing the principles of the invention. Connected to the torque plates 24 are a pair of end covers 28 for the engine. Extending through the end covers 28 and into the engine are a pair of engine shafts 30 and 31. Each of these shafts fits within a bore 32 that is formed within a generally cylindrical end portion 34 of a wobbler 36. Each shaft is connected to its wobbler end portion by a key 38. Surrounding each wobbler end portion 34 is a spider assembly 40. Each spider assembly has a tubular barrel portion 42 that fits around the wobbler end portion and integral pairs of arms 44 that extend radially from the outer end of each barrel portion.

Each pair of spider arms 44 is fixed to a connecting rod 46 that extends into a cylinder module 26 and is connected to a piston carrier 48 for a piston 50.

Each cylinder module supports two pistons which move simultaneously in opposite directions during engine operation. Mounted in each cylinder module is a fuel injector nozzle 52 of a suitable type which injects atomized fuel between the two pistons when they are in their top dead center positions. Spaced near one end of each module are exhaust ports 54 and near the other end are air inlet ports 56. The exhaust ports are all connected to a generally circular exhaust manifold 58 for the engine. Similarly, the air inlet ports are connected to a common inlet manifold 60.

As each piston moves within its module, its connecting rod 46 forces the connected spider 40 to move through an angle downwardly toward the shaft which is connected to an end portion 34 of the wobbler 36 within the spider barrel 42. Since the direction of the axis of piston movement is slightly to one side of the wobbler, the tipping action of the spider assembly 40 causes a rotation of the wobbler and the connected shafts 30 and 31 with each piston stroke. The driving connection between the spider and the wobbler includes pairs of inner and outer bearings 62 and 64 located at opposite ends of each wobbler barrel. As indicated diagrammatically in FIG. 1A, each power stroke of each piston produces extremely high stress loads on the bearings between each relatively moving spider barrel 42 and the wobbler end portion or slug 34 which rotates within it. In accordance with the present invention the bearings 62 and 64 are constructed so as to withstand the forces of the spider on the wobbler with each piston stroke and yet provide smooth engine operation with minimum friction losses.

Wobbler Bearings

In order for the engine 20 to operate efficiently with minimal friction in accordance with the invention, the wobbler bearings 62, 64 must have a relatively small clearance approximating the oil film thickness, during loaded operation. This is because the spider barrel 42 is loaded at opposite corners by the forces F during each power stroke, as shown diagrammatically in FIG. 1A. If the bearing clearance was excessive it would create a situation wherein the bearing surfaces would not be parallel. This would limit the effective bearing area and also permit metal to metal contact. The bearing clearance must also remain constant during engine operation. If the clearance should decrease below a critical level, the bearing would bind, causing increased friction, and if the clearance increased excessively, the parallel geometry of the bearing surfaces could be affected. In order to help maintain a constant, small clearance for the bearings, the vertices of the core angle for the bearings at the opposite ends of the wobbler must coincide, as indicated at 65 in FIG. 1A. Thus, if the inside bearing element expands at a greater rate than the outside element, the diameter and length of the bearings will both expand proportionally while maintaining the parallel relationship of all bearing surfaces.

Figure 1A:
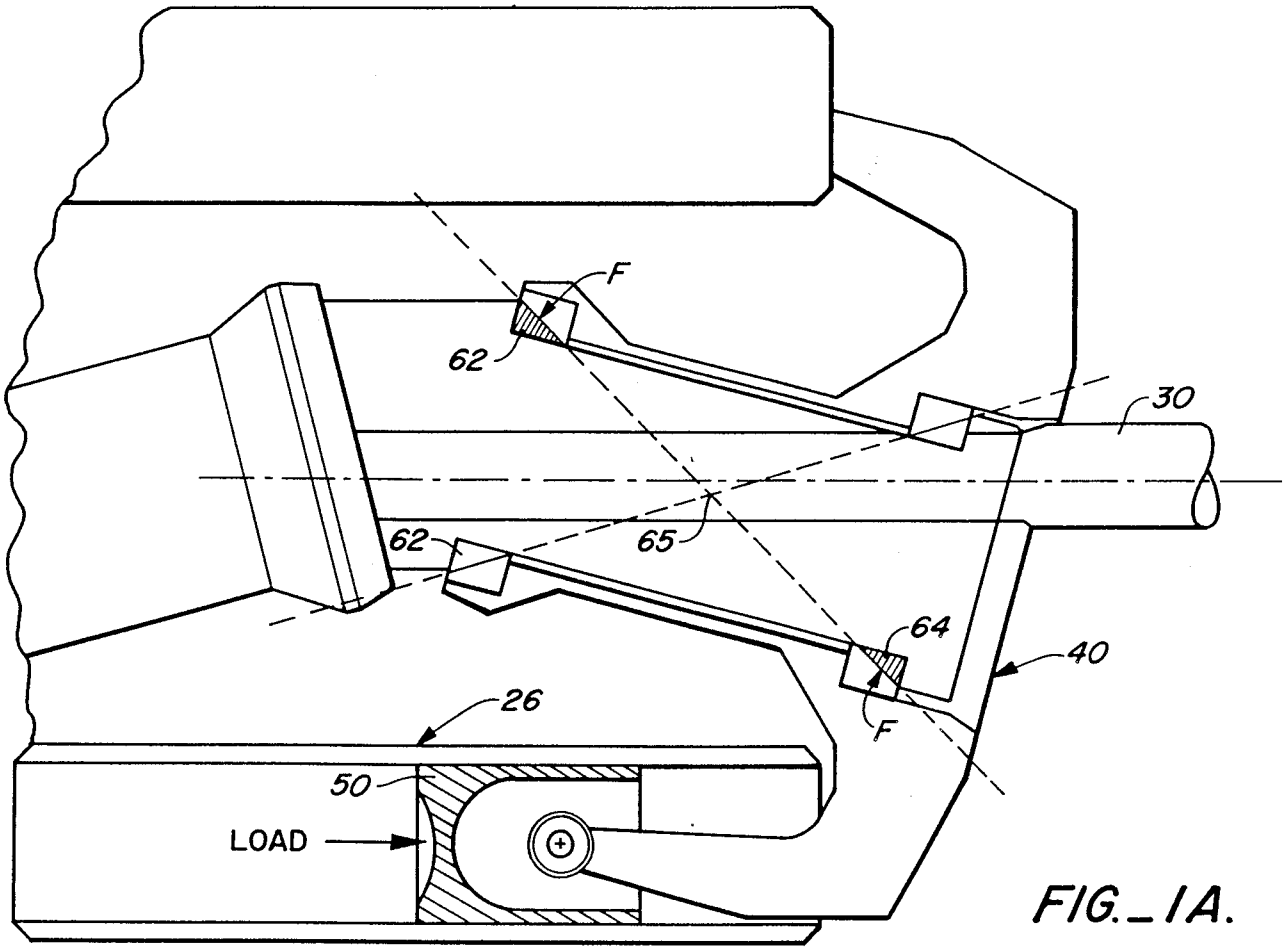
FIG. 1A is a diagrammatic representation of one portion of the engine showing forces F on the bearings during a power stroke of one piston.
Figure 3:
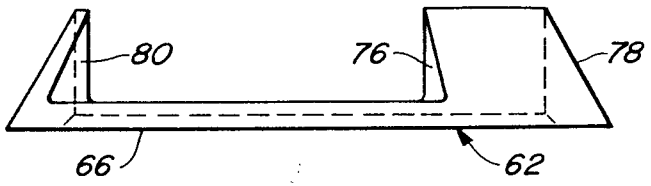
FIG. 3 is a view in elevation of the wobbler bearing shown in FIG. 2.
Figure 2:
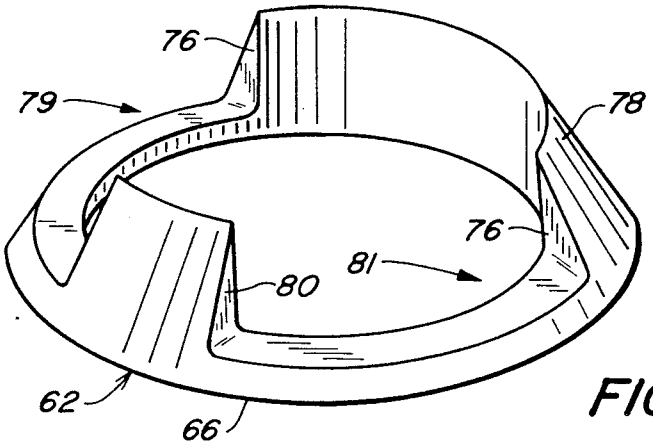
FIG. 2 is a view in perspective of a wobbler bearing for the engine of FIG. 1.
Figure 5:
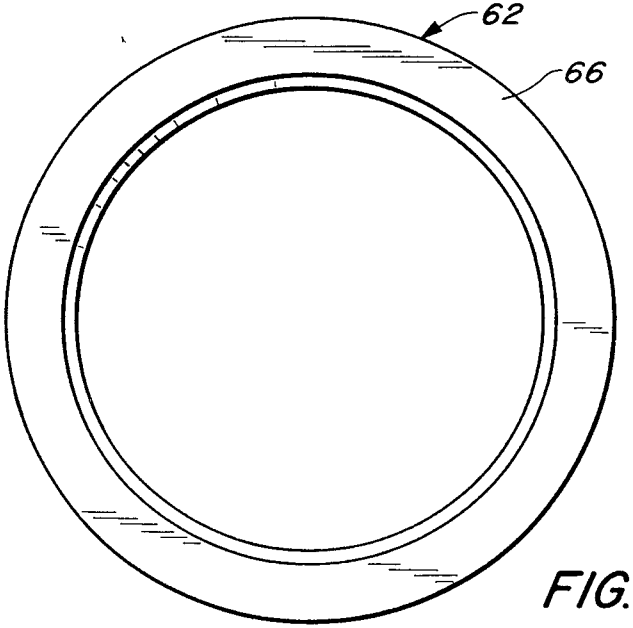
FIG. 5 is a bottom view of the wobbler bearing of FIG. 2.
Figure 4:
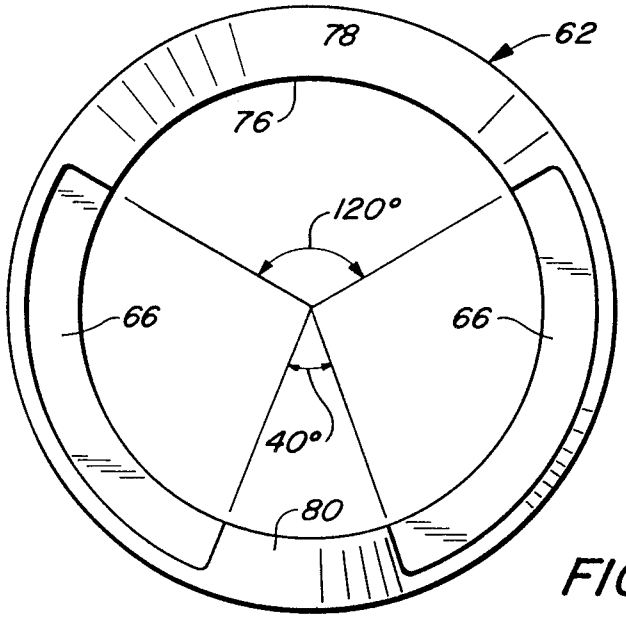
FIG. 4 is a top view of the wobbler bearing shown in FIG. 2.
Figure 6:
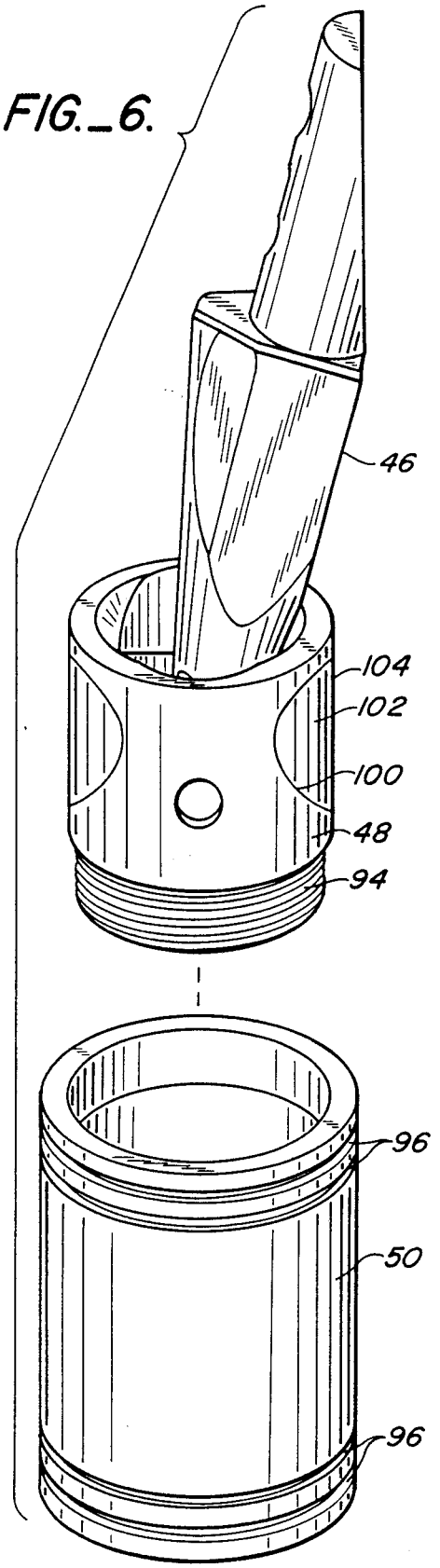
FIG. 6 is an exploded view in perspective of one connecting rod and piston for the engine of FIG. 1.

Each bearing has a generally annular base portion 66 with spaced apart frustro-conical portions integral with it. Thus, as shown in FIG. 1 each base portion has a flat annular surface forming its base and the frustro-conical portions have outer conical surfaces 68. At the inner end of each wobbler barrel the base of a bearing 62 fits against an annular shoulder 70 on the wobbler so that the conical surfaces 68 form an angle with the centerline of the wobbler. Extended lines from the two conical surfaces meet at a common vertex 65, as indicated in FIG. 1A. At the outer end of each wobbler, a bearing 64 fits around it with its annular base surface 66 retained by an end plate 72. The end plate is secured to the wobbler by machine screws 74.

As shown in FIGS. 2–5, each bearing 62 and 64 has arcuate portions along its annular base 66 that are removed from a generally frustro-conical configuration to form a first arcuate portion 76 having an outer first arcuate conical surface 78 which is diametrically opposite from a second arcuate portion 80. The first arcuate portion 76 on each bearing base covers an angle of around 120° and is arcuately at least twice as long as the second arcuate portion 80 which covers an angle of around 40° on the circular base ring 66. These arcuate conical surface areas 78 and 80 are in the areas where the reactive forces F are applied during each power stroke, as shown in FIG. 1A. Thus, when the bearings are installed on each wobbler, the first or larger arcuate portion 78 is positioned on the side of the wobbler which normally receives the most stress during engine operation, as shown diagrammatically in FIG. 1A. Conversely, the smaller arcuate portion 80 of each bearing is located on the other side of the wobbler where the operating stresses are considerably less. Since bearing portions have been removed from areas 79 and 81 between the larger and smaller arcuate sections, no bearing friction occurs at these locations and the bearings can operate with minimum friction at maximum efficiency.

At opposite ends of the spider barrel portion 42 which extends around a wobbler member 34, are annular recesses for retaining bearing cups 82 and 84 of the conventional type, as shown in FIG. 1. Each bearing cup has an outer face 86 which forms an angle with the wobbler centerline and is adjacent the conical surfaces 78 and 80 of each bearing 62 and 64. The spaces and clearances between the bearing cup faces and the conical bearing surfaces are filled with a film of oil 88 during engine operation which is provided by the lubrication system described below.

By the use of shims (not shown) in the conventional manner, the bearings 62 and 64 can be moved axially in a manner to provide means for adjusting their clearance on the wobbler 34. This clearance will then remain constant during engine operation despite varying temperature cycles. Because the bearing clearances are relatively low, the less loaded portions of conventional bearings would also cause considerable friction losses. In the present invention these less loaded bearing areas are either relieved or actually cut away as in the areas 79 and 81 in bearings 62 and 64, thereby eliminating any close proximity of metal to metal and consequently any frictional losses in such areas. For example, in the embodiment shown in FIGS. 2–5, over one-half of the normal bearing friction is eliminated.

As the inner portion of each bearing 62 and 64 rotates on the wobbler, it follows the reactive load around a circle, like an automotive distributor, from cylinder to cylinder as each cylinder provides a power stroke. The outer narrow ring at the edge of each relieved bearing 62 and 64 serves to retain the lubricating oil and bearing. Because the cylinders fire sequentially, the greatest bearing loads are always centered on the unrelieved, load-bearing portions 76 and 80 of the bearing as the shaft 30 rotates. Thus a single set of bearing surfaces can service all of the cylinders. In summary, because the total bearing area for the engine 20 is only a fraction of what a conventional engine would require, the unit loading of the bearings 62 and 64 can readily be decreased without paying a large price in friction loss, even to a point where at low starting or idling speeds there is never any metal-to-metal contact in the bearings.

The Piston Rod Connection

As each piston 50 moves outwardly within its cylinder module 26 on a power stroke, its connecting rod 46 pushes the spider 40 into its tilting motion which in turn exerts a rotational force on the wobbler 36 through the bearings 62 and 64, as described. As this movement of the piston and its connecting rod takes place, different forces act upon them which require certain degrees of movement. At its outer end, each connecting rod is fixed to a pair of spider arms 44 by a plurality of machine screws 90. Thus, the forces produced on the connecting rod with each power stroke must be accommodated or compensated by the connection of the rod 46 to the piston rod connection. The piston invention, as shown in FIGS. 6 to 11 solves this problem by means of a unique, multi-component piston rod connection joint 92.

Figure 7:
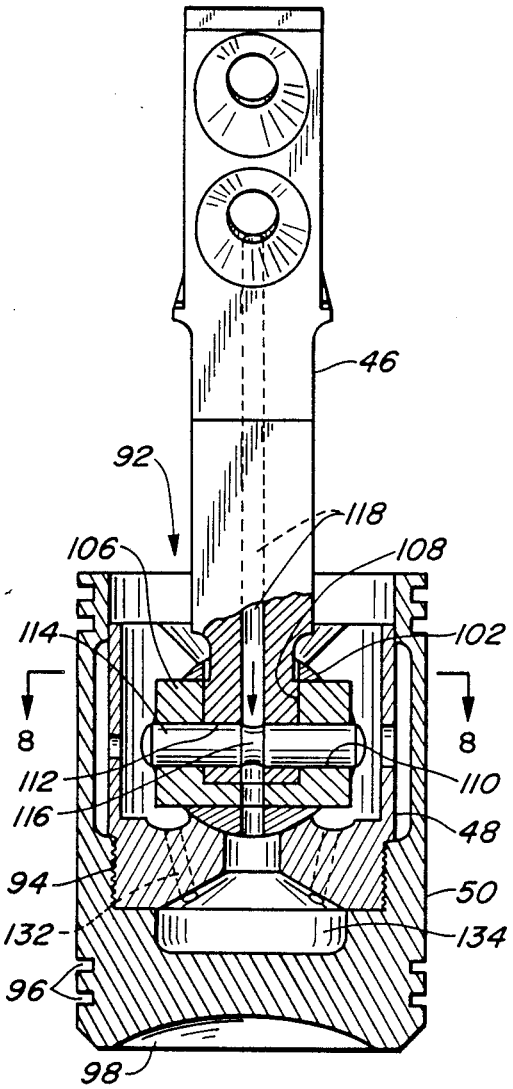
FIG. 7 is a view in elevation and partially in section showing the assembled piston and connecting rod of FIG. 6.
Figure 8:
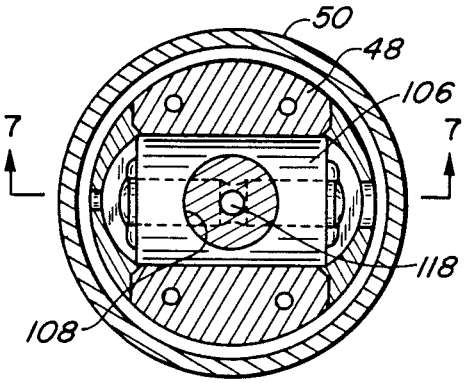
FIG. 8 is a view in section taken along line 8—8 of FIG. 7.

As shown in FIGS. 7 and 8, a piston carrier 48 having a generally cylindrical shape, is secured within the hollow piston 50 by a series of threads 94. The piston is provided with pairs of oil ring grooves 96 near its opposite ends in the conventional manner, and the inner end of the piston preferably has a curved depression 98 that serves as a combustion chamber.

The opposite sides of the piston carrier have aligned circular openings 100 to accommodate a piston carrier pin 102 which has curved end portions 104 that are flush with the piston carrier's outer cylindrical surface when the pin 102 is in place. Transverse to the centerline of the piston carrier pin 102 is a bore for receiving a connecting rod pin 106. Extending into one side of the connecting rod pin at its midpoint is a circular bore 108 for receiving the inner end of the connecting rod 46. There is an axial bore 110 extending through the connecting rod pin 106 and a similar bore 112 of the same diameter that extends through the inner end of the connecting rod 46 for accommodating a removable lock pin 114. This lock pin has convex end surfaces and an annular oil groove 116 at its mid-point which is located within an oil passage 118 in the connecting rod 46 when the rod joint is assembled.

Figure 10:
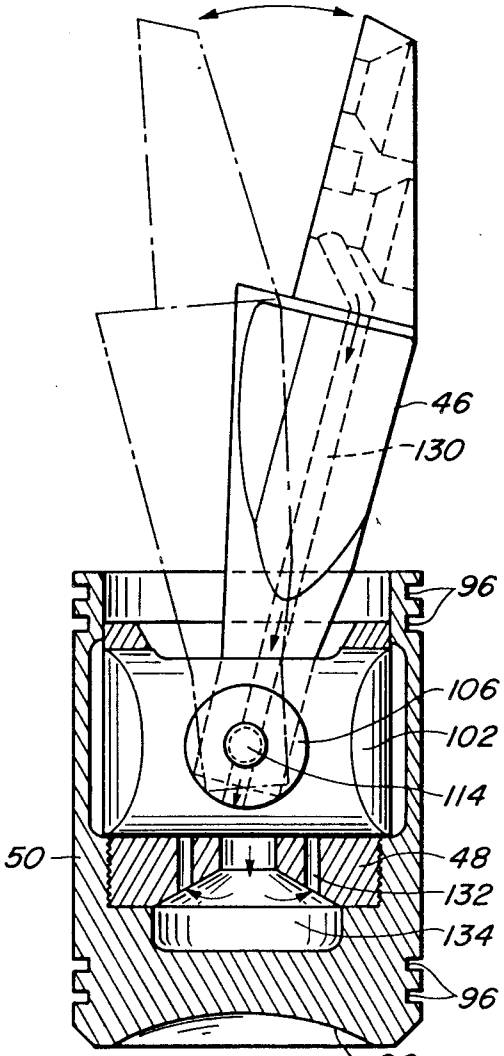
FIG. 10 is a view in elevation and partially in section showing the assembled piston and connecting rod as it appears in a position that it rotated 90° to the view of FIG. 9.
Figure 9:
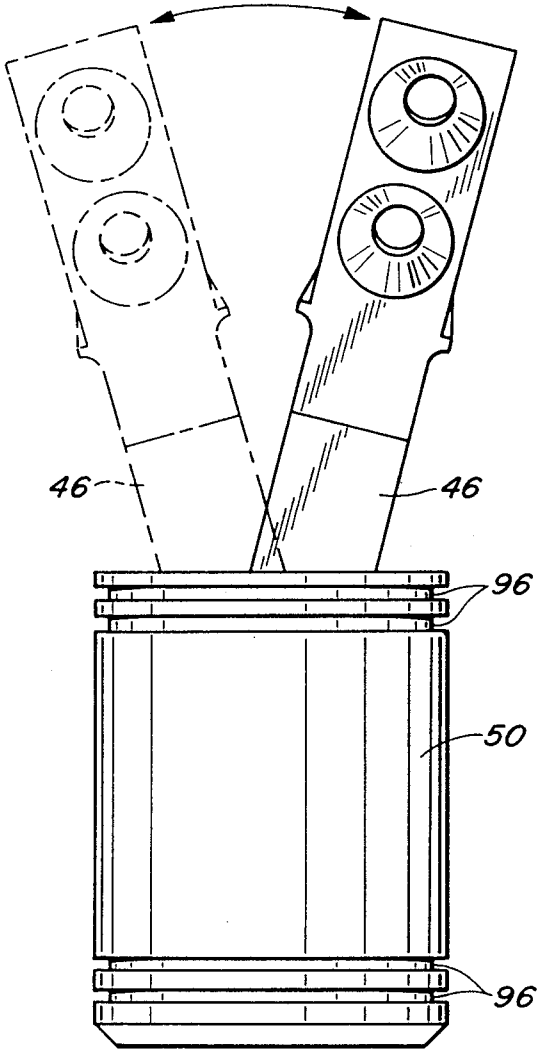
FIG. 9 is a view in elevation of an assembled piston and connecting rod for the engine of FIG. 1, with the connecting rod shown in an alternate position of travel which occurs in normal operation.

The aforesaid arrangement of elements comprising the piston/rod connection joint 92 enables it to accommodate with a minimum of stress and wear all of the forces encountered at the joint during each power stroke of the piston. Thus, as shown in FIG. 9, as the connecting rod 46 moves laterally to accommodate spider motion, its inner end can move by virtue of the piston carrier pin rotation. When the piston rod must move up and down, as shown in FIG. 10, the inner end of the rod can accommodate such movement by virtue of connecting rod pin rotation within the piston carrier pin.

Figure 11:
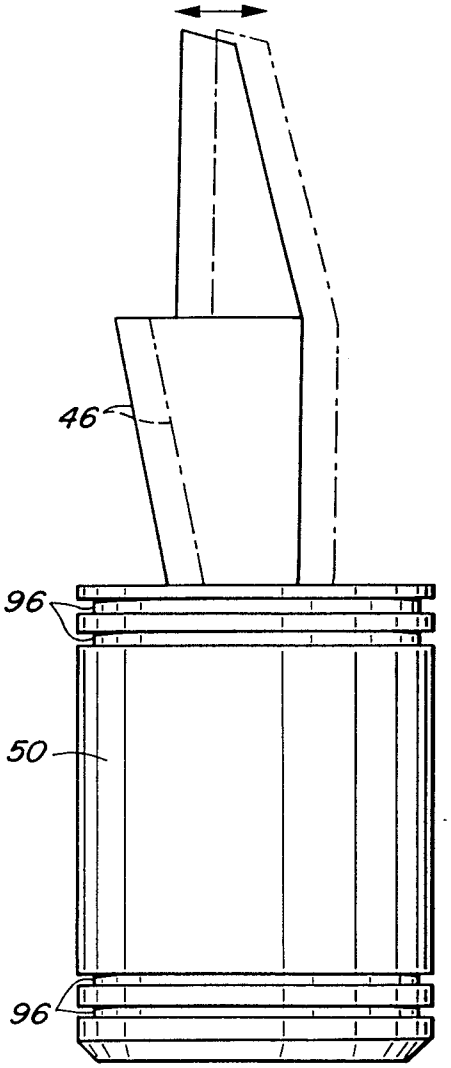
FIG. 11 is a view in elevation of the assembled piston and connecting rod with an alternate position of the connecting rod shown in phantom to illustrate travel during normal engine operation.

A further degree of movement for the connecting rod 46 during the power stroke, is provided, as shown in FIG. 11, by virtue of the fact that the piston carrier pin 102 is free to move back and forth a limited amount within its bore in the piston carrier 48. This movement within the joint 92 accommodates the normal reaction to side loads on the connection rod due to the fact that its force is applied slightly off center to the wobbler through the spider.

In summary, whether the engine is built with two or six pairs of cylinders, the multi-element joint construction for each rod and piston is able to accommodate all of the force in them and also relative motion between them on each power stroke.

Lubrication System

A pressurized lubrication system is provided for the engine 20 that furnishes oil to all moving parts. Oil from a suitable pump (not shown) is furnished through a central passage 120 in the engine shaft 30, as shown in FIG. 1. From the central passage, oil flows through a passage 122 in the wobbler to an annular space 124 between the wobbler and the spider barrel section. Oil in this annular space also flows between each of the bearings 62, 64 and their adjacent bearing cups 82, 84. Another passage 125 in the spider barrel allows oil to flow through connecting passages 126 and 128 into a longitudinal passage 118 in each connecting rod 46. Now, as shown in FIG. 10, oil through the rod passage 118 flows into the connecting rod joint 92 through oil drain holes 132 in the piston carrier 48 and into an oil cooling chamber 134 for each piston. When the oil under pressure has circulated through the engine parts, it collects in a sump 136 that is formed by the engine housing components. A drain line (not shown) from the engine sump returns oil to the engine pump for recirculation through the lubrication system.

Engine Timing

As shown in FIG. 1, the double end wobbler 36 and the two connected spider components 40 with their connected pistons 50 form a central assembly that is movable longitudinally within the cylinder modules 26 and the engine housing 22 to adjust the timing action of the engine. As described, each cylinder module is provided with air intake ports 56 and exhaust ports 54 at fixed locations. When the pistons are moved longitudinally within their respective cylinder modules, the location of the pistons 50 is changed relative to the intake and exhaust ports and this essentially changes engine timing. For example, if the assembly is shifted toward the exhaust port end of the cylinders, the exhaust ports will open earlier and the intake ports open later, thus giving more time for the exhaust blowdown event and permitting a higher engine speed.

Figure 14:
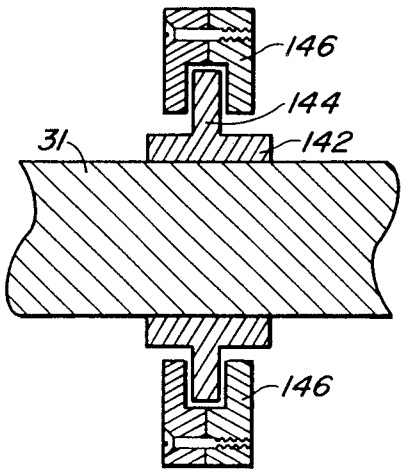
FIG. 14 is a view in perspective taken along line 14—14 of FIG. 12.
Figure 13:
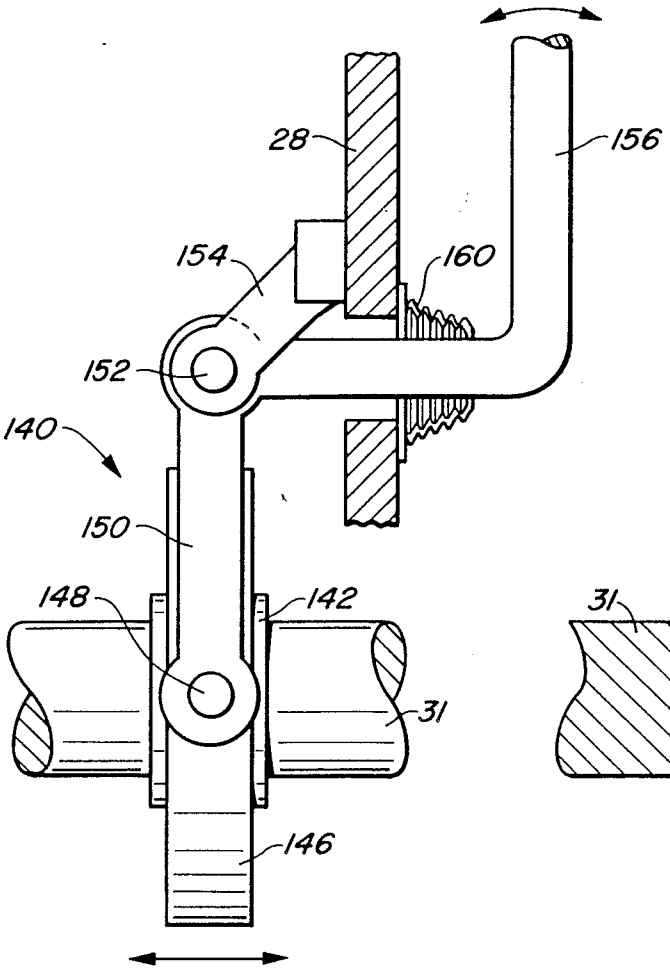
FIG. 13 is a view in elevation and in section taken along the line 13—13 of FIG. 12.
Figure 12:
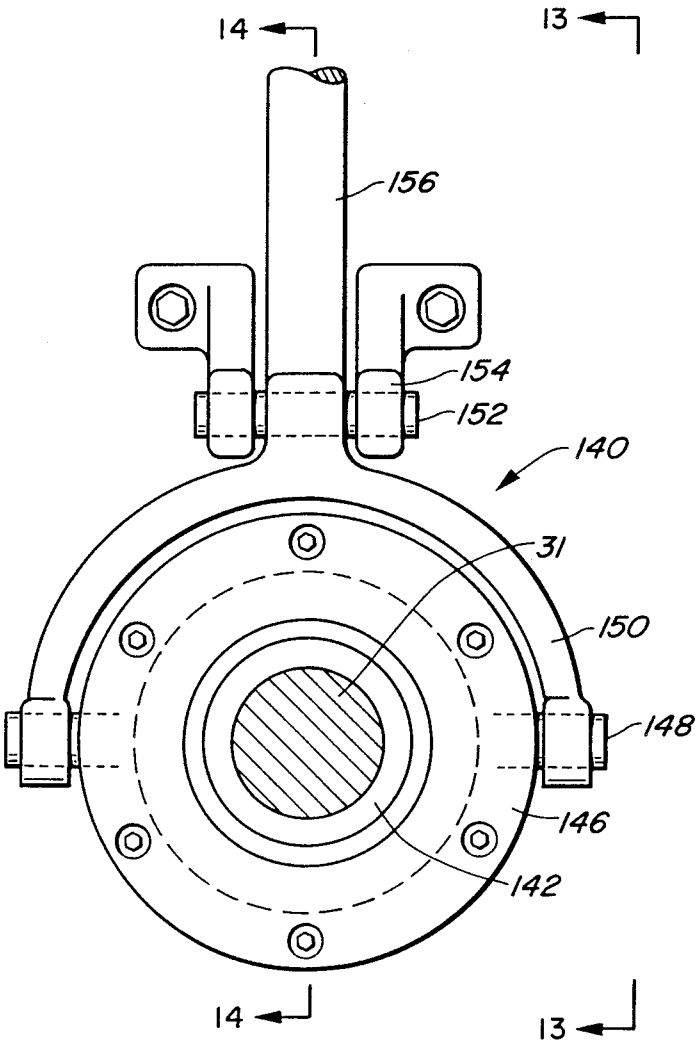
FIG. 12 is an end view in section taken along line 12—12 of FIG. 1 showing a variable timing component for the engine.

As shown in FIGS. 12–14, the longitudinal movement of the wobbler and spider assembly to change engine timing is accomplished by a yoke assembly 140 that is attached to the engine shaft 31. In the arrangement shown, a sleeve 142 having a central, radially extending flange 144 is attached to the shaft within the engine housing. An annular two-directional thrust bearing 146 is mounted around the flange and is attached by a pair of pins 148 to a yoke member 150. As seen in FIGS. 12 and 13, the yoke is pivotally supported on a pin 152 which is supported by a pair of arms 154 that are anchored to the inside of the engine housing. A variable timing lever arm 156 is fixed to the yoke and extends through an opening 158 in the engine housing 22. The latter opening is preferably sealed by a flexible boot 160 made of neoprene or some suitable material. As indicated, movement of the lever arm causes a similar movement of the yoke which moves the engine shaft and the attached spider/wobbler assembly axially within the engine housing. Only a slight movement by the yoke is necessary to change the engine timing as the pistons in each cylinder module are relocated relative to their intake and exhaust ports.

To those skilled in the art to which this invention relates, many changes in construction and widely differing embodiments and applications of the invention will suggest themselves without departing from the spirit and scope of the invention. The disclosure and the description herein are purely illustrative and are not intended to be in any sense limiting.

What is claimed is:

1. An internal combustion engine comprising:

an engine block including a plurality of parallel, spaced apart cylinder modules, each module having a cylinder bore and a pair of pistons in each bore which are simultaneously movable in opposite directions;

fuel injection means between each pair of pistons;

rotatable shaft means parallel to said cylinder modules;

a wobbler member connected to and rotatable with said shaft means, said wobbler member having a pair of cylindrical shaped end portions connected by a central portion, each said cylindrical end portion having a centerline forming an angle with said rotatable shaft;

a spider assembly connected to each said wobbler end portion;

a pair of bearing members within each said spider assembly located at opposite ends of each said wobbler end portion, each said bearing member having a general frustro-conical annular shape with relieved areas in its outer surface to provide reduced bearing friction;

a connecting rod for each said piston having an outer end and an inner end;

means for fixing the outer end of each connecting rod to said spider assembly;

means for connecting the inner end of each connecting rod to a said piston so as to provide both rotational as well as linear side movement of said connecting rod inner end within its piston; and lubrication means for supplying liquid lubricant under pressure to said bearings and said inner ends of said pistons.

2. The engine as described in claim 1 wherein said bearing members at each end of each said wobbler end portion have sloping outer surfaces coincident with extended lines that meet at a common vertex, said surfaces being parallel with mating bearing surfaces within said spider assembly.

3. The engine as described in claim 1 wherein each said spider assembly comprises an outer portion with a plurality of radially extending arms and a barrel portion surrounding a said wobbler end portion.

4. The engine as described in claim 3 including annular bearing cup means within said barrel portion of said spider assembly having sloped bearing surfaces that are parallel to sloped surfaces of said frustro-conical bearing members.

5. The engine as described in claim 1 wherein each said annular bearing member has a full circle base retaining ring portion and two frustro-conical portions spaced apart and integral with said ring portion.

6. The engine as described in claim 5 wherein on each said bearing member one of said frustro-conical portions has a larger conical surface area than the other frustro-conical portion and is positioned within the spider assembly to receive the maximum bearing stress during each power stroke of the engine.

7. The engine as described in claim 5 wherein one said frustro-conical portion includes a conical surface area on the bearing within an arc of around 120°, and the other smaller frustro-conical portion includes a conical surface area within an arc of around 40°, said conical surface areas being separated by relieved areas in said bearing member.

8. The engine as described in claim 1 wherein said means for connecting the inner end of each connecting rod to said piston comprises a carrier pin rotatably mounted within said piston, a connecting rod pin extending transverse through the center line of said carrier pin and having a bore for receiving said inner end of the connecting rod, and lock pin extending through said connecting rod and said connecting rod pin, said connecting rod pin being movable laterally as well as rotatably a slight amount within said carrier pin during each power stroke to relieve stress on said connecting rod connection.

9. The engine as described in claim 8 and an oil groove means in said lock pin and oil passage means in said connecting rod for receiving lubricant under pressure from said lubrication means.

10. The engine as described in claim 8 including a piston carrier within each said piston for retaining said carrier pin.

11. The engine as described in claim 1 wherein said lubrication means includes fluid passages within said shaft, said wobbler end portions, through said spider assembly and through each said piston connecting rod.

12. The engine as described in claim 11 wherein said lubrication means includes means for collecting and recirculating the liquid lubricant continuously through said passages.

13. The engine as described in claim 1 wherein said engine block surrounds said plurality of cylinder modules;

means for securing said cylinder modules together within said engine block;

each said cylinder having an inlet port and an exhaust port spaced longitudinally from said inlet port;

an inlet manifold means for said inlet ports on all said cylinder modules and an exhaust manifold means for said exhaust ports, said manifold means being fixed to said engine block; and engine timing means for moving said spider assemblies and said pistons linearly within each of their respective cylinder modules a predetermined distance, thereby changing the position of said pistons relative to the inlet and exhaust ports in each cylinder module and consequently altering the engine timing.

14. The engine as described in claim 13 wherein said engine timing means comprises a linkage connected to said shaft means, including lever means mounted outside of said engine block for moving said shaft means, said spider assemblies and said pistons a preselected linear distance within said block.

15. The engine as described in claim 1 which includes at least four cylinder modules, each having a pair of pistons for moving two spider assemblies.

* * * * *